US006484712B1

(12) United States Patent
Lyons et al.

(10) Patent No.: US 6,484,712 B1
(45) **Date of Patent: *Nov. 26, 2002**

(54) VENT COVER ASSEMBLY

(75) Inventors: David Charles Lyons, Red Wing; Robb Edward Bennett, Prior Lake, both of MN (US)

(73) Assignee: HON Technology Inc., Muscatine, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 87 days.

(21) Appl. No.: 09/482,227

(22) Filed: Jan. 13, 2000

(51) Int. Cl.[7] ..... F23L 17/02
(52) U.S. Cl. ..... 126/85 B; 454/8; 454/33
(58) Field of Search ..... 454/33, 35, 39, 454/40; 126/85 B

(56) References Cited

U.S. PATENT DOCUMENTS

| | | | |
|---|---|---|---|
| 2,964,034 | A | 12/1960 | Nordholt et al. |
| 2,966,838 | A | 1/1961 | Thompson et al. |
| 3,105,432 | A | 10/1963 | Chamberlain |
| 3,192,852 | A | 7/1965 | Stark et al. |
| 3,315,586 | A | 4/1967 | Marrapese et al. |
| 3,654,913 | A | 4/1972 | Derringer et al. |
| 3,727,539 | A | 4/1973 | Wilmes |
| 3,874,363 | A | 4/1975 | Biedenbender et al. |
| 4,016,730 | A | 4/1977 | De Villiers |
| D261,924 | S | 11/1981 | Donohue |
| 4,690,129 | A | 9/1987 | Halstead |
| 4,940,042 | A | 7/1990 | Moore, Jr. et al. |
| 5,562,088 | A | 10/1996 | Valters et al. |
| 5,715,808 | A | 2/1998 | Wilhoite |

*Primary Examiner*—Harold Joyce
*Assistant Examiner*—Derek S. Boles
(74) *Attorney, Agent, or Firm*—Merchant & Gould P.C.

(57) ABSTRACT

The present invention is directed toward a vent assembly having a vent structure defining at least one vent aperture. The vent assembly includes a vent cap covering the vent aperture or apertures and a vent cover assembly extending around the vent cap and the vent.

In one embodiment, the invention is directed toward a vent cover assembly for use with a vent including a vent cap that covers the vent. The vent cover assembly includes a protective structural member extending around the vent cap. The protective structural member allows for proper air flow into and out of the vent cap.

In another embodiment, the invention is directed toward a vent cover assembly that has an attachment base and a plurality of semi-cylindrical members connected to the attachment base.

27 Claims, 4 Drawing Sheets

VENT COVER ASSEMBLY

FIELD OF INVENTION

This invention relates generally to a structural member that encompasses a cover or a shroud for a vent. More particularly, this invention relates to a vent cover assembly that provides an additional cover or shroud for intake and/or outake vents that already include a vent cap.

BACKGROUND OF THE RELATED ART

Exterior intake and/or exhaust vents are generally known for use in buildings and other such structures. Such vents can be used for a broad variety of venting purposes, for example, to vent fireplaces, furnaces, water heaters, boilers, dryers, exhaust fans, and a broad variety of other such appliances and devices. Some such vents are primarily exhaust vents, others are primarily intake vents, and still others include structure that allows them to function as both intake and exhaust vents.

For example, chimneyless gas fireplaces often include intake/exhaust venting units that are mounted on the outside of an exterior wall for providing a through-the-wall connection to a double walled collinear ducting of the gas fireplace. The double walled collinear ducting includes an inner duct that serves as an outake port for exhaust fumes, and an outer duct that serves as an intake port for providing ambient combustion air. The venting units generally include an inner and an outer duct. Further, the double walled ducting is connected to a series of bases that have deflectors and heat shields. The venting unit has a series of venting apertures with a vent cap attached thereto. The vent cap is utilized to cover both the air intake and the combustion product exhaust.

Regardless of the specific structure or use of the vent, most venting systems generally include a functional vent cap that covers the intake and exhaust portions of the vent. However, many of the existing vent caps are not aesthetically pleasing, may get hot due to high temperature exhaust gases, and are exposed to the ambient atmosphere and therefore may be damaged.

SUMMARY OF THE INVENTION

One aspect of the present invention is a vent assembly having a vent structure defining at least one vent aperture. The vent assembly includes a vent cap covering the vent aperture or apertures and a vent cover assembly extending around the vent cap and the vent.

Another aspect of the present invention is a vent cover assembly for use with a vent including a vent cap that covers the vent. The vent cover assembly includes a protective structural member extending around the vent cap. The protective structural member allows for proper air flow into and out of the vent cap.

A further aspect of the present invention is a vent cover assembly that has an attachment base and a plurality of semi-cylindrical members connected to the attachment base.

Another aspect of the present invention is a vent cover assembly that has an attachment base being positioned over a vent cap. A first semi-cylindrical member is connected to the attachment base, and a second semi-cylindrical member is connected to the attachment base. The second semi-cylindrical member has a lesser diameter than the first semi-cylindrical member and is positioned below the first semi-cylindrical member and is connected to the attachment base. A third semi-cylindrical member is connected to the attachment base and has a lesser diameter than the second semi-cylindrical member. The third semi-cylindrical member is positioned below the second semi-cylindrical member and is connected to the attachment base. A top screen is positioned within the upper edge of the first semi-cylindrical member and is connected to the first semi-cylindrical member. A bottom screen is positioned within the lower edge of the third semi-cylindrical member and is connected to the third semi-cylindrical member. Further, an opening is located within the top screen.

BRIEF DESCRIPTION OF THE DRAWINGS

The organization and manner of the structure and operation of the invention, and advantages thereof, may best be understood by reference to the following description, taken in connection with the accompanying drawings, wherein like reference numerals identify like elements throughout the views, in which.

DETAILED DESCRIPTION OF AN EMBODIMENT

Figure 1:
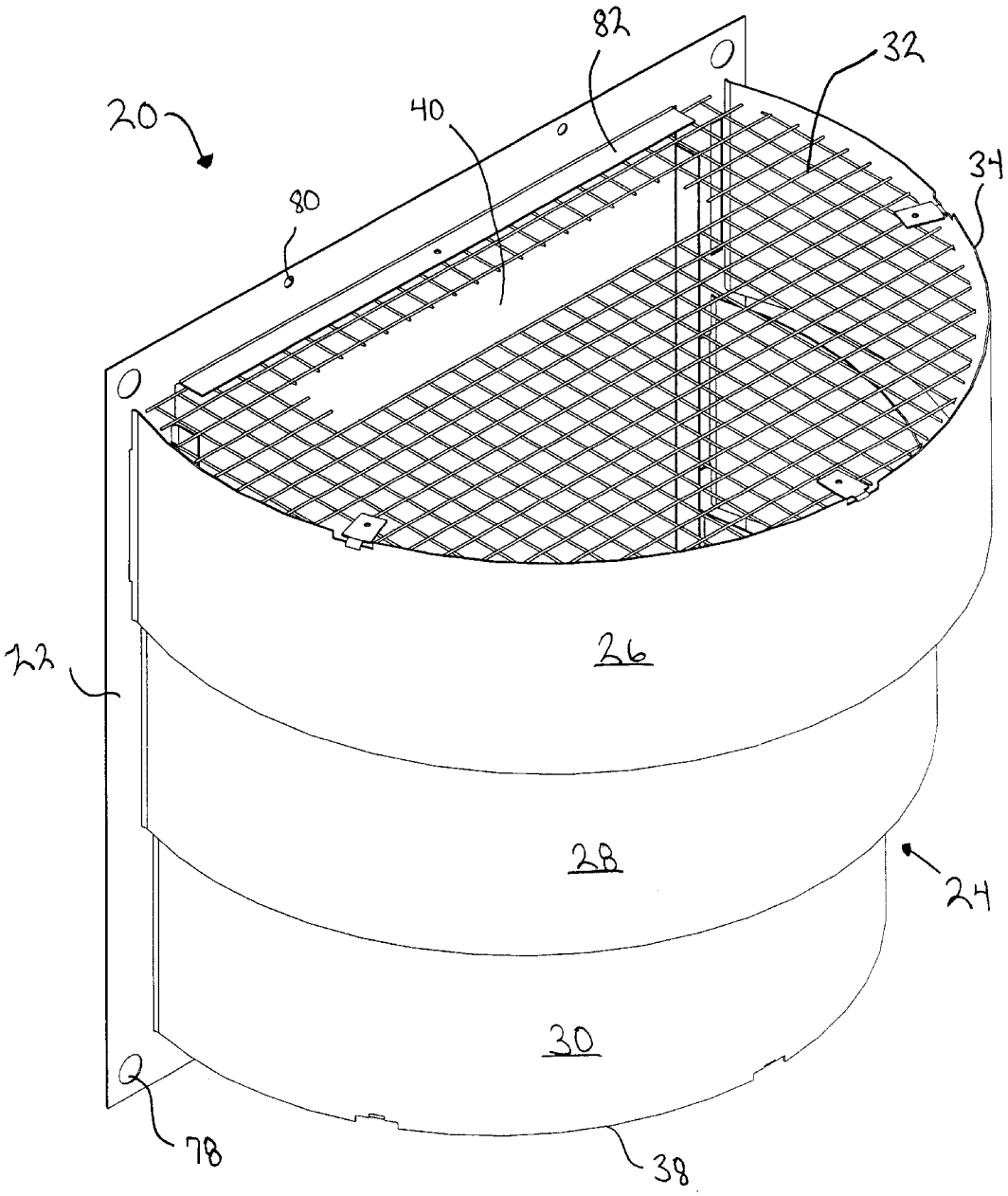
FIG. 1 is a perspective view of the vent cover assembly in a possible embodiment of the present invention.

Preferred embodiments of the present invention will be described in detail with reference to the drawings, wherein like reference numerals represent like parts and assemblies throughout the several views. This description does not limit the scope of the invention, which is limited only by the scope of the attached claims.

Referring now to FIG. 1, which illustrates the vent cover assembly, identified generally as 20, in one possible embodiment of the present invention. Generally, the vent cover assembly 20 includes an attachment base 22. A protective structural assembly, shown generally as 24, depends from the attachment base 22. It should be understood that the protective structural assembly 24 can be made up of any suitably sized and shaped component or components that are adapted to be positioned around an existing vent cap of a vent, as will be discussed more fully below. The protective structural assembly 24 typically includes at least one semi-cylindrical member. In the embodiment in FIG. 1, three semi-circular members are included. A first semi-cylindrical member 26 is connected to the attachment base 22. A second semi-cylindrical member 28 is positioned below the first semi-cylindrical member 26 and is connected to the attachment base 22. A third semi-cylindrical member 30 is positioned below the second semi-cylindrical member 28 and is connected to the attachment base 22. A top screen 32 is positioned within the upper edge 34 of the first semi-cylindrical member 26 and is connected to the first semi-cylindrical member. A bottom screen 36 (FIG. 2) is positioned within the lower edge 38 of the third semi-cylindrical member 30 and is connected to the third semi-cylindrical member 30. Additionally, an opening 40 is located within the top screen 32.

Figure 2:
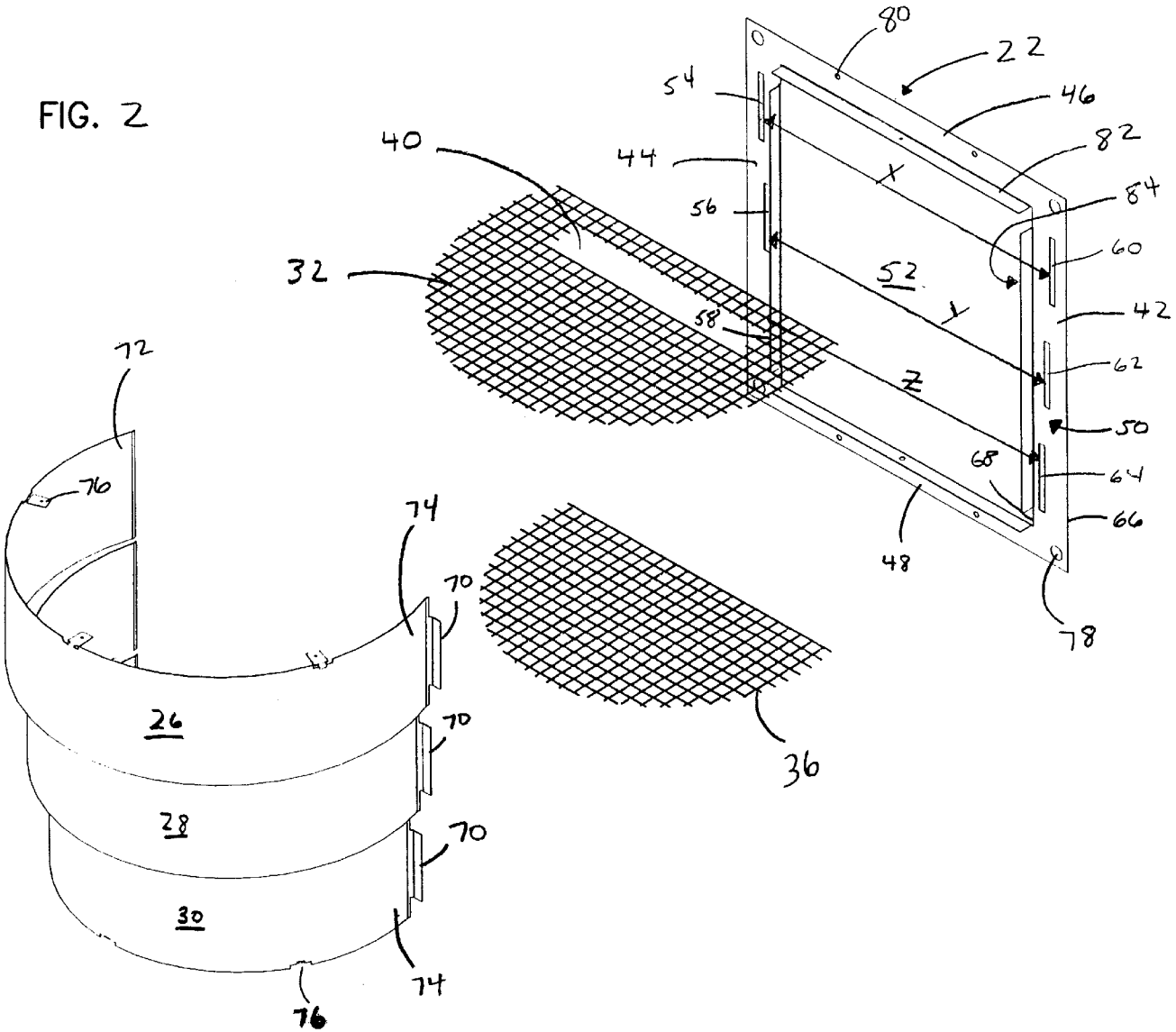
FIG. 2 is an exploded isometric view of the vent cover assembly of FIG. 1.

As can best be seen in FIG. 2, in one embodiment the attachment base 22 is generally square-shaped with a first side 42, a second side 44, a third side 46, and a fourth side 48. The attachment base 22 is typically of sufficient size to be positioned over the existing vent cap of a vent and to be attached around the vent, which is discussed more fully below. The attachment base 22 has a perimeter portion 50, typically approximately 1–2 inches wide, with a cut-out interior 52. Three slots 54, 56, 58 and 60, 62, 64, are cut into each the first side 42 and second side 44 of the attachment base 22 to allow each of the three semi-cylindrical members 26, 28, 30 to attach thereto. The slots 54, 60, positioned nearest the third side 46 of the attachment base 22, are located nearest the outer edge 66 of the perimeter portion 50 of the attachment base 22. The slots 58, 66, positioned nearest the fourth side 48 of the attachment base 22, are located nearest the inner edge 68 of the perimeter portion 50 of the attachment base 22. The slots 56, 62, positioned in between the aforementioned slots 54, 58 and 60, 64, are positioned nearest the middle of the perimeter portion 50 of the attachment base 22. Accordingly, distance X between slots 54 and 60 is the largest of the three distances, X, Y, and Z. Distance Y between slots 56 and 62 is the next largest of the three distances X, Y, and Z. Distance Z between slots 58 and 64 is the smallest of the three distances X, Y, and Z. The decreasing distance, X to Y to Z, between the aligned slots accounts for the decreasing diameter of the semi-cylindrical members 26, 28, 30, from the third side 46 to the fourth side 48 of the attachment base 22.

The attachment base 22 is typically manufactured with a sheet metal material. However, any suitable flame-retardant material may be used.

Each of the semi-cylindrical members 26, 28, 30 has insert tabs 70 at each of its ends 72, 74. The insert tabs 70 are inserted into the slots 54, 56, 58, 60, 62, 64, on the attachment base 22, securing the semi-cylindrical members 26, 28, 30, to the attachment base 22. The insert tabs 70 may also then be further secured to the attachment base 22 by means of bolting or welding, or any other appropriate method. Each semi-cylindrical member 26, 28, 30, is cut to a length so as the first semi-cylindrical member 26 has the largest diameter when secured to the attachment base 22, and the third semi-cylindrical member 30 has the smallest diameter when secured to the attachment base 22. A typical diameter of the first semi-cylindrical member 26 is approximately 13–14 inches. A typical diameter of the second semi-cylindrical member 38 is approximately 12–13 inches. A typical diameter of the third semi-cylindrical member 30 is approximately 11–12 inches.

Each of the three semi-cylindrical members 26, 28, 30, is also typically manufactured with a sheet metal material. However, any suitable flame-retardant material may be used.

In one possible embodiment of the present invention, the top screen 32 is positioned within the upper edge 34 of the first semi-cylindrical member 26 and is attached to the first semi-cylindrical member 26. The top screen 32 is sized to fit the shape of the first semi-cylindrical member 26. The top screen 32 is attached to the first semi-cylindrical member 26 by any such fastening means suitable, such as screw, rivet, or any other appropriate attachment mechanism. The first semi-cylindrical member 26 may have tabs 76 extending therefrom for helping in the attachment to the top screen 32.

An opening 40 is located within the top screen 32. The opening 40 is of sufficient size so as to allow for the shield of the existing vent cap to fit into the vent cap assembly 20 (discussed below), while still maintaining appropriate size and shape of the vent cover assembly 20 for proper appearance, efficiency, and productivity.

A bottom screen 36 is positioned within the lower edge 38 of the third semi-cylindrical member 30 and is attached to the third semi-cylindrical member. The bottom screen 36 is sized to fit the shape of the third semi-cylindrical member 30. The bottom screen 36 is attached to the third semi-cylindrical member 30 by any such fastening means suitable, such as screw, rivet, or any other appropriate attachment mechanism. The third semi-cylindrical member 30 may also have tabs 76 extending therefrom for helping in the attachment to the bottom screen 36.

The top screen 32 and the bottom screen 36 are also typically manufactured with a sheet metal material. However, any suitable flame-retardant material may be used.

Preferably, the attachment base 22 has holes 78 positioned in each of its four comers of the perimeter portion 50, and holes 80 along the sides 42, 44, 46, 48, of its perimeter portion 50, so that the attachment base may be attached properly to either the base of the existing vent cap or the exterior of the house (discussed below). Holes may also be put into the attachment base 22 to allow for attachment to either the top screen 32 and/or bottom screen 36.

The attachment base 22 may have ridges 82 located along the interior side 84 of the perimeter portion 50 of the attachment base 22. Typically the ridges 82 would be positioned at a 90 degree angle to the perimeter portion. The ridges 82 assist in both sealing and stabilizing the vent cover assembly 20 to the existing vent cap and its base.

Figure 3:
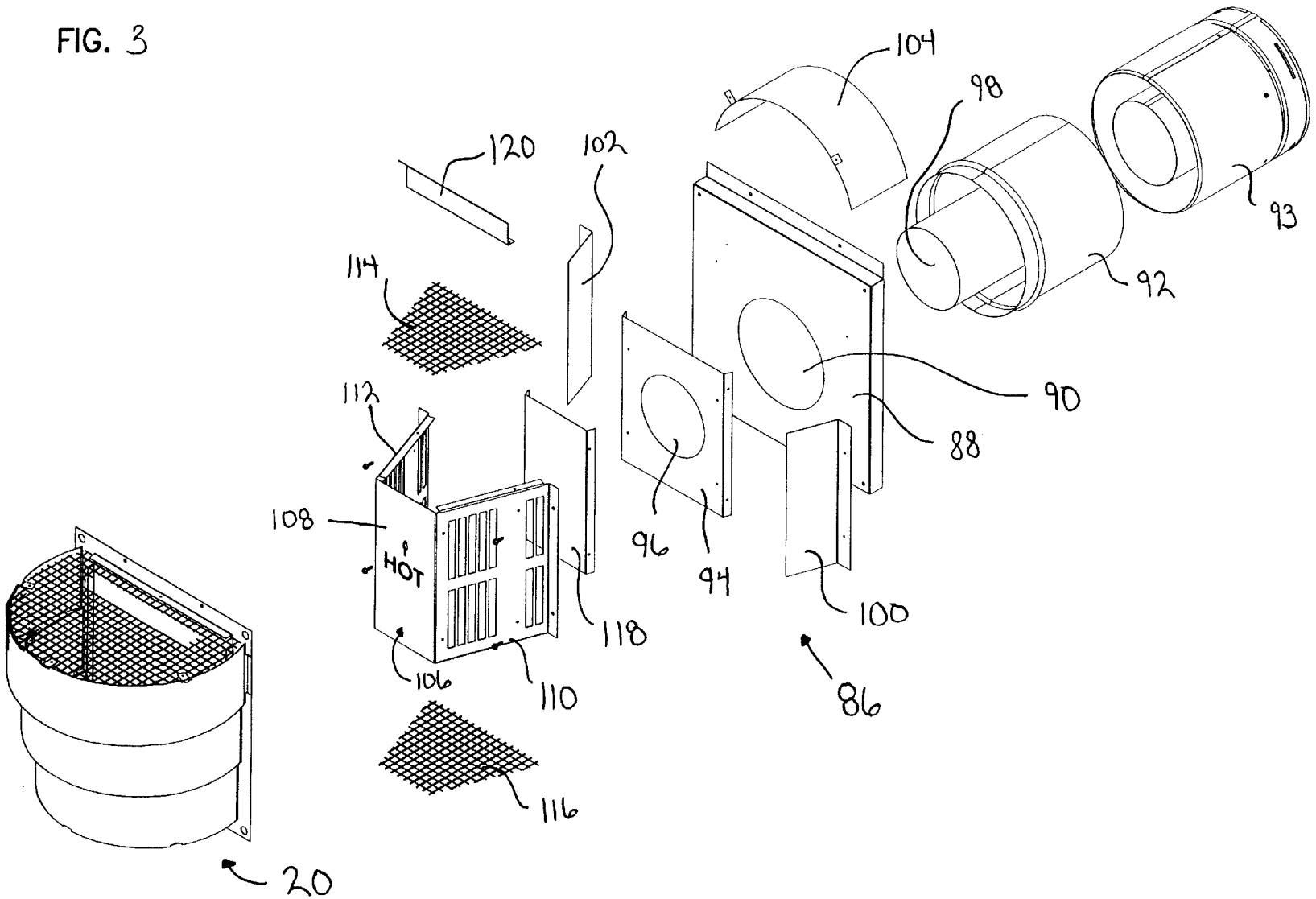
FIG. 3 is a perspective view of the vent cover assembly of FIG. 1, shown in its preferred position in relation to a horizontal direct vent gas fireplace venting system shown in exploded view.

FIG. 3 is a perspective view of the vent cover assembly 20 according to one possible embodiment of the present invention. The vent cover assembly 20 is shown in position in relation to a horizontal direct vent gas fireplace venting system, shown generally as 86. The horizontal direct vent gas fireplace venting system 86 is shown in exploded view.

A conventional horizontal direct gas fireplace venting system 86 typically includes a base 88 having a circular opening 90 therethrough in which is mounted an outer starting collar 92 that projects inwardly relative to the base 88 when the outer starting collar is mounted to the exterior of a wall to extend through the passage of the wall for connection to the outer pipe extension assembly 93 of a double walled or collinear ducting arrangement. The outer starting collar 92 and the outer pipe extension assembly 93 allow for intake combustion airflow into the fireplace. A sub-base 94 has a circular opening 96 therethrough in which is mounted an inner starting collar 98 that projects inwardly relative to the sub-base 94 when the outer starting collar 92 is mounted to the exterior of a wall to extend through the passage of the wall for the connection to the inner pipe extension assembly of a double walled or collinear ducting arrangement. The inner starting collar 98 and inner pipe extension assembly allow for combustion product exhaust.

Attached to the base are two deflectors 100, 102. The deflectors 100, 102 are shaped to provide a converging angle in order to deflect airflow into the mouth of the outer starting collar 92 around the inner starting collar 98. Further, a first heat shield unit 104 with a semi-cylindrical shape is connected to the base 88 as a protection from the hot combustion product exhaust.

Supported outwardly in spaced relation from the base 88 is a vent cap 106 which is comprised of a top member 108 having two member side panels 110, 112 angularly spaced outwardly away from the top member 108. The top member 108 and the two side panel members 110, 112 have a first mesh screen 114 and a second mesh screen 116 that is connected thereto in order to form an enclosed vent cap 106. A second heat shield 118 is positioned within the vent cap 106 as a protection from the hot combustion product exhaust. A top shield 120 is further connected to the two side panels 110, 112 of the vent cap 106 for deflecting the combustion product exhaust to the outer environment, deflecting the combustion product exhaust away from the intake air as well as the immediate exterior of the house.

The vent cover assembly 20 of the present invention is preferably sized so as to be positioned over the existing vent cap 106, and attach to its base 88. The attachment base 22 of the vent cover assembly 20 can attach to the base 88 of the existing vent cap 106 by use of the holes 78 and 80 in the perimeter portion 50 of the attachment base 22, and by screw, rivet, or any other appropriate attachment mechanism. Also, the attachment base 22 of the vent cover assembly 20 could attach directly to the exterior of the house 122 (FIG. 4).

Figure 4:
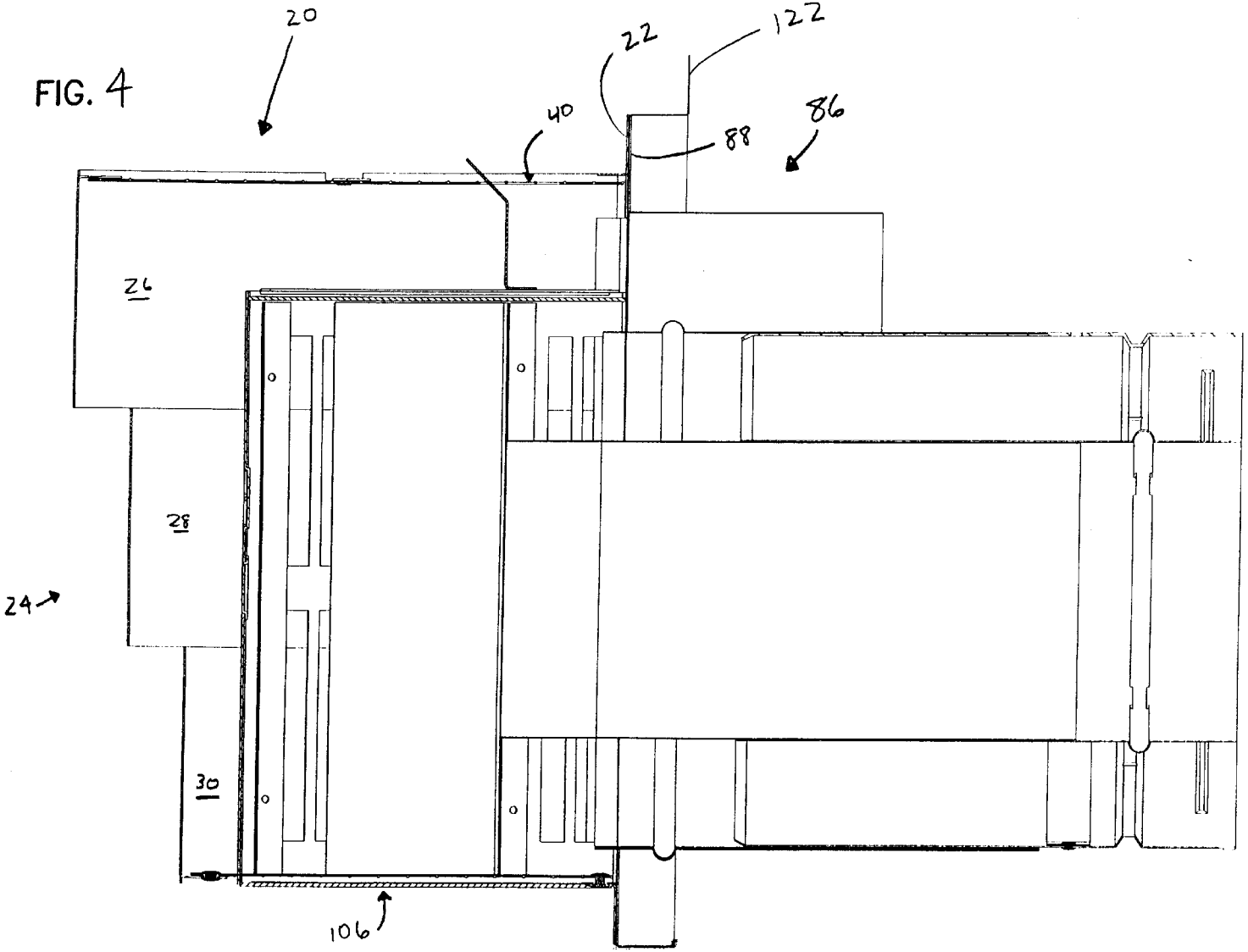
FIG. 4 is a cross-sectional view of the vent cover assembly of FIG. 1 attached to a horizontal direct vent gas fireplace venting system.

As can be seen in the cross-section of FIG. 4, when in use over a horizontal direct vent gas fireplace venting system 86, the vent cover assembly 20 is positioned over the existing vent cap 106 positioned at the exterior of a house 122. The attachment base 22 is preferably attached directly to the base 88 of the existing vent cap 106. The opening 40 located in the top screen 32 allows the top shield 120 of the vent cap 106 to be positioned therein, and perform as designed.

While one particular embodiment has been described, it should be understood that the invention is not limited to the particular structure described. It is contemplated that the additional vent shroud or cover of the invention may include many shapes and designs that would be useful to cover or surround an existing vent cap. Additionally, while the vent cover assembly 20 described is typically used with such a horizontal direct vent gas fireplace 86, the vent cover assembly 20 can be used to cover other types of vents such as vent fireplaces, furnaces, water heaters, boilers, dryers, exhaust fans, and a broad variety of other such appliances and devices. The protective structural member 24 allows for proper air flow into and of the vent cap. Further, the vent cover assembly 20 of the present invention also offers protection from the vent cap, which can become very hot during use. The vent cover assembly 20 also helps to further protect the existing vent cap from the outside elements. Furthermore, the vent cover assembly improves the appearance of the existing exterior venting system.

The foregoing description of the invention has been presented for purposes of illustration and description, and is not intended to be exhaustive or to limit the invention to the precise form disclosed. The description was selected to explain the principles of the invention in various embodiments and various modifications as are suited to the particular use contemplated. It is intended that the scope of the invention not be limited by the specification, but defined by the claims set forth below.

The claimed invention is:

1. A vent cover assembly for use with a vent, the vent including an intake vent aperture, an exhaust vent aperture, and a vent cap that extends around and covers the intake and exhaust vent apertures, the vent cover assembly comprising:

a protective structural member extending around the vent cap, wherein the protective structural member allows for proper air flow into and out of the vent cap.

2. The vent cover assembly of claim 1, further comprising an attachment base.

3. The vent cover assembly of claim 1, wherein the vent cover assembly is manufactured with a sheet metal material.

4. The vent cover assembly of claim 1, wherein the vent is a horizontal vent of a direct vent fireplace.

5. The vent cover assembly of claim 4, wherein the horizontal direct vent gas fireplace includes a pipe extension assembly that allows for intake and outake air flow into the horizontal direct vent gas fireplace.

6. The vent cover assembly of claim 2, wherein the protective structural member comprises a first semi-cylindrical member connected to the attachment base.

7. The vent cover assembly of claim 6, wherein a top screen is positioned within the upper edge of the first semi-cylindrical member.

8. The vent cover assembly of claim 7, wherein the top screen has an opening located therein.

9. The vent cover assembly of claim 6, wherein the protective structural member further comprises a second semi-cylindrical member positioned below the first semi-cylindrical member and connected to the attachment base.

10. The vent cover assembly of claim 9, wherein the protective structural member further comprises a third semi-cylindrical member positioned below the second semi-cylindrical member and connected to the attachment base.

11. The vent cover assembly of claim 10, wherein a bottom screen is positioned within the lower edge of the third semi-cylindrical member.

12. A vent cover assembly comprising:

an attachment base;

a first semi-cylindrical member connected to the attachment;

a second semi-cylindrical member positioned below the first semi-cylindrical member and connected to the attachment base;

wherein the diameter of the first semi-cylindrical member is greater then the diameter of the second semi-cylindrical member.

13. The vent cover assembly of claim 12, wherein the vent cover assembly is manufactured with a sheet metal material.

14. The vent cover assembly of claim 12, wherein the attachment base can be positioned over a vent cap.

15. The vent cover assembly of claim 12, wherein a top screen is positioned within the upper edge of the first semi-cylindrical member.

16. The vent cover assembly of claim 15, wherein the top screen has an opening located therein.

17. The vent cover assembly of claim 16, wherein the opening permits a vent cap shield to extend through the opening of the vent cover assembly.

18. A vent cover assembly of claim 12, wherein a third semi-cylindrical member is positioned below the second semi-cylindrical member and is connected the attachment base.

19. The vent cover assembly of claim 18, wherein the diameter of the second semi-cylindrical member is greater than the diameter of the third semi-cylindrical member.

20. A vent cover assembly of claim 18, wherein a bottom screen positioned within the lower edge of the third semi-cylindrical member.

21. A vent cover assembly comprising:

an attachment base being positioned over a vent cap;

a first semi-cylindrical member connected to the attachment base;

a second semi-cylindrical member connected to the attachment base and having a lesser diameter than the first semi-cylindrical member and being positioned below the first semi-cylindrical member and connected to the attachment base;

a third semi-cylindrical member connected to the attachment base and having a lesser diameter than the second semi-cylindrical member and being positioned below the second semi-cylindrical member and connected to the attachment base;

a top screen positioned within the upper edge of the first semi-cylindrical member and connected to the first semi-cylindrical member;

a bottom screen positioned within the lower edge of the third semi-cylindrical member and connected to the third semi-cylindrical member; and an opening located within the top screen.

22. A vent assembly comprising:

a vent structure defining an intake vent aperture and an exhaust vent aperture;

a vent cap that extends around and covers both the intake vent aperture and the exhaust vent aperture; and a vent cover assembly extending around the vent cap and the intake vent aperture and the exhaust vent aperture.

23. The vent assembly of claim 22, wherein the vent structure is a horizontal vent of a direct vent fireplace.

24. The vent assembly of claim 23, wherein the horizontal direct vent gas fireplace includes a pipe extension assembly that allows for intake and outtake air flow into the horizontal direct vent gas fireplace.

25. The vent cover assembly of claim 22, wherein the vent cover assembly comprises a first semi-cylindrical member.

26. The vent cover assembly of claim 25, wherein the protective structural member further comprises a second semi-cylindrical member positioned below the first semi-cylindrical member.

27. The vent cover assembly of claim 26, wherein the protective structural member further comprises a third semi-cylindrical member positioned below the second semi-cylindrical member.

* * * * *